US007081542B2

(12) United States Patent
Jacobs et al.

(10) Patent No.: US 7,081,542 B2
(45) Date of Patent: Jul. 25, 2006

(54) CHEMICAL PROCESS FOR THE PRODUCTION OF 1,3-DIGLYCERIDE OILS

(75) Inventors: Lewis Jacobs, Decatur, IL (US); Immok Lee, Dacatur, IL (US); George Poppe, Forsyth, IL (US)

(73) Assignee: Archer-Daniels-Midland Company, Decatur, IL (US)

( * ) Notice: Subject to any disclaimer, the term of this patent is extended or adjusted under 35 U.S.C. 154(b) by 849 days.

(21) Appl. No.: 10/263,331

(22) Filed: Oct. 3, 2002

(65) Prior Publication Data

US 2003/0104109 A1 Jun. 5, 2003

Related U.S. Application Data

(60) Provisional application No. 60/327,762, filed on Oct. 3, 2001.

(51) Int. Cl.
*C11C 1/00* (2006.01)

(52) U.S. Cl. ..... 554/169

(58) Field of Classification Search ..... 554/169
See application file for complete search history.

(56) References Cited

U.S. PATENT DOCUMENTS

| | | | |
|---|---|---|---|
| 2,206,168 | A | 7/1940 | Edeler et al. |
| 2,626,952 | A | 1/1953 | Lange et al. |
| 3,360,533 | A | 12/1967 | Wootton et al. |
| 3,634,473 | A | 1/1972 | Harwood |
| 6,004,611 | A | 12/1999 | Gotoh et al. ..... 426/612 |

FOREIGN PATENT DOCUMENTS

| | | |
|---|---|---|
| EP | 0 307 154 B2 | 3/1989 |
| GB | 617078 | 2/1949 |
| GB | 0 010 333 A1 | 4/1980 |
| WO | WO 99/09119 | 2/1999 |

OTHER PUBLICATIONS

Pending non-provisional U.S. Appl. No. 10/100,188, Lee et al., filed Mar. 19, 2002 (Not. published).
International Search Report for International Application No. PCT/US02/31360, Jacobs et al., filed Oct. 3, 2002.

*Primary Examiner*—Deborah D. Carr
(74) *Attorney, Agent, or Firm*—Kirkpatrick & Lockhart Nicholson Graham LLP

(57) ABSTRACT

A method for producing 1,3-diglyceride oils from triglyceride containing oils is disclosed. The method uses alkali metal salts or alkali earth metal salts of mono-carboxylic or di-carboxylic acids to drive glycerolysis under conditions such that commercial, food-quality 1,3-diglyceride oils are produced.

44 Claims, 1 Drawing Sheet

CHEMICAL PROCESS FOR THE PRODUCTION OF 1,3-DIGLYCERIDE OILS

CROSS-REFERENCE TO RELATED APPLICATIONS

This application claims the benefit of U.S. Provisional Application No. 60/327,762, filed Oct. 3, 2001, the contents of which are fully incorporated by reference herein.

FIELD OF THE INVENTION

The present invention relates to a method for producing 1,3-diglyceride oils from triglyceride containing oils. More specifically, the invention uses alkali metal salts or alkali earth metal salts of mono-carboxylic or di-carboxylic acids to drive glycerolysis under conditions such that commercial, food-quality 1,3-diglyceride oils are produced.

BACKGROUND OF THE INVENTION

With obesity on the rise in the industrialized countries, the incidence of degenerative diseases such as cardiovascular disease, hypertension and diabetes is also rising at alarming rates. While obesity can be due to a combination of genetic, psychological, socioeconomic and cultural factors, a more straightforward, bottom-line explanation is that obesity is "caused" by an imbalance of energy intake as compared to energy expenditure. As humans continually become more aware of the health risks associated with obesity, more people are trying to live healthier lives, which typically includes eating healthier.

Much of the blame for the rise in obesity and disease has been focused on fats and oils. Although fats and oils are critical to a balanced diet, many people in the industrialized countries have a tendency to consume more than is needed. A major source of consumption of fats and oils is foods that have been fried or baked in cooking oil. These cooking oils absorb into the food and give it certain texture, color and palatable qualities to which people have become accustomed. Simply eliminating these cooking oils or fried foods from the diet often leaves people feeling unsatisfied, or decreases the flavor and palatability of foods to the consumer, so that motivation to eat such foods for a potential health benefit is short lived. So far, low fat oil substitutes have generally proven to be unsuccessful. The public does not seem to be willing to compromise taste for health. Healthier, more palatable edible oils may be the key to controlling the incidence of obesity and certain diseases.

U.S. Pat. No. 6,004,611 discloses an edible oil composition having unique nutritional benefits. The majority of this edible oil composition is diglycerides, of which the 1,3-diglycerides (comprising more than 40% of the oil) are considered to be the actual beneficial component. When edible oils of triglyceride nature are digested, they are broken up into fat components. The body packages the components into triglycerides, and transports them to the tissue while the liver handles the excess.

Triglycerides are stored in the adipose tissue until the body needs them for energy at a later time. However, the body does not package the digested components of 1,3-diglycerides as it does the triglycerides. Therefore, the components of 1–3-diglycerides are transported to the liver to be metabolized. In other patent publications from the same assignee (EP 0 307 154 B2, WO 99/09119) the inventors disclose a process for the preparation of this diglyceride (DG) oil. They disclose a process which includes splitting or partially splitting triglyceride oils to yield the corresponding fatty acids, followed by the separation and fractionation of these fatty acids, and then the selective enzymatic esterification of the fractionated acids with glycerol to make a DG oil rich in 1,3-diglycerides. The DG oil is further processed to attain the desired color and flavor. This patent teaches that a 1,3-specific enzyme is used for this esterification reaction to increase the content of 1,3-diglycerides. To maximize the positional specificity, the DG oil was also prepared from fatty acids and glycerol (the products of the fat splitting reaction of triglyceride (TG) oils).

The process disclosed in WO 99/09119 has several side effects that are labor intensive and expensive to overcome. During the fat splitting step, the triglyceride oil feedstock is subjected to high temperature and high pressure, which causes discoloration and contamination of the reaction products with high levels of trace metals and trans fatty acids. Also, glycerol is recovered as an aqueous solution and has to be distilled and cleaned in order to be used in subsequent esterification reactions. The fatty acids also have to be cleaned, either before esterification or after esterification, to be suitable for an edible application.

It has long been known that the positional isomers of partial glycerides, such as monoglycerides (MG) or diglycerides, reach an equilibrium composition at a certain ratio of the possible positional isomers. Thus, even though the process disclosed in WO 99/09119 achieves a DG oil with a high level of 1,3-diglyceride through the selective enzymatic esterification reaction, the final ratio of 1,3- to 1,2-diglycerides comes to equilibrium following esterification and storage of the product.

SUMMARY OF THE INVENTION

In an effort to produce DG oils rich in 1,3-diglycerides in a simpler and more economical manner, it has been determined that DG oil compositions can be prepared chemically. Chemical preparation of DG oils avoids the fat splitting, fatty acid separation, clean-up and selective enzymatic esterification steps required in the method disclosed in WO 99/09119. When diglyceride oil was prepared chemically, as described in the following examples, the ratio of 1,3- to 1,2-diglycerides was essentially the same as the commercially available DG oil product.

Therefore, the present invention relates to a method of producing 1,3-diglyceride oils. In the method, oils containing triglycerides are reacted with a catalyst to achieve glycerolysis. The catalyst is chosen from among alkali metal salts or alkali earth metal salts of mono-carboxylic or di-carboxylic acids, or the catalyst may be a mixture thereof. By way of example, the catalyst may be a lithium, sodium, potassium, calcium, magnesium, or barium salt of a mono-carboxylic or di-carboxylic acid. As noted above, the catalyst can also be a mixture of such compositions.

Another advantage of the present chemical process over the enzymatic process disclosed in WO 99/09119 is that a large variety of DG oil products having different physical properties can be produced for various applications such as shortenings, margarines, frying fats, and the like. The products that can be made by enzymatic esterification are limited due to the enzyme's thermal stability and the acyl migration that occurs during enzymatic esterification at higher temperatures. In the WO 99/09119 document, the esterification was done at 40° C. in order to maintain enzyme stability and viability, and to minimize acyl migration, which can increase the formation of TG and change the ratio of positional isomers. Due to the high-melting characteristics of many fats, it is not practical to prepare these forms of DG products by the enzymatic process. There is no such limitation, however, for the instant chemical process. The present chemical method opens up the opportunity to manufacture a variety of DG oil products, which could not be made enzymatically.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

Figure 1:
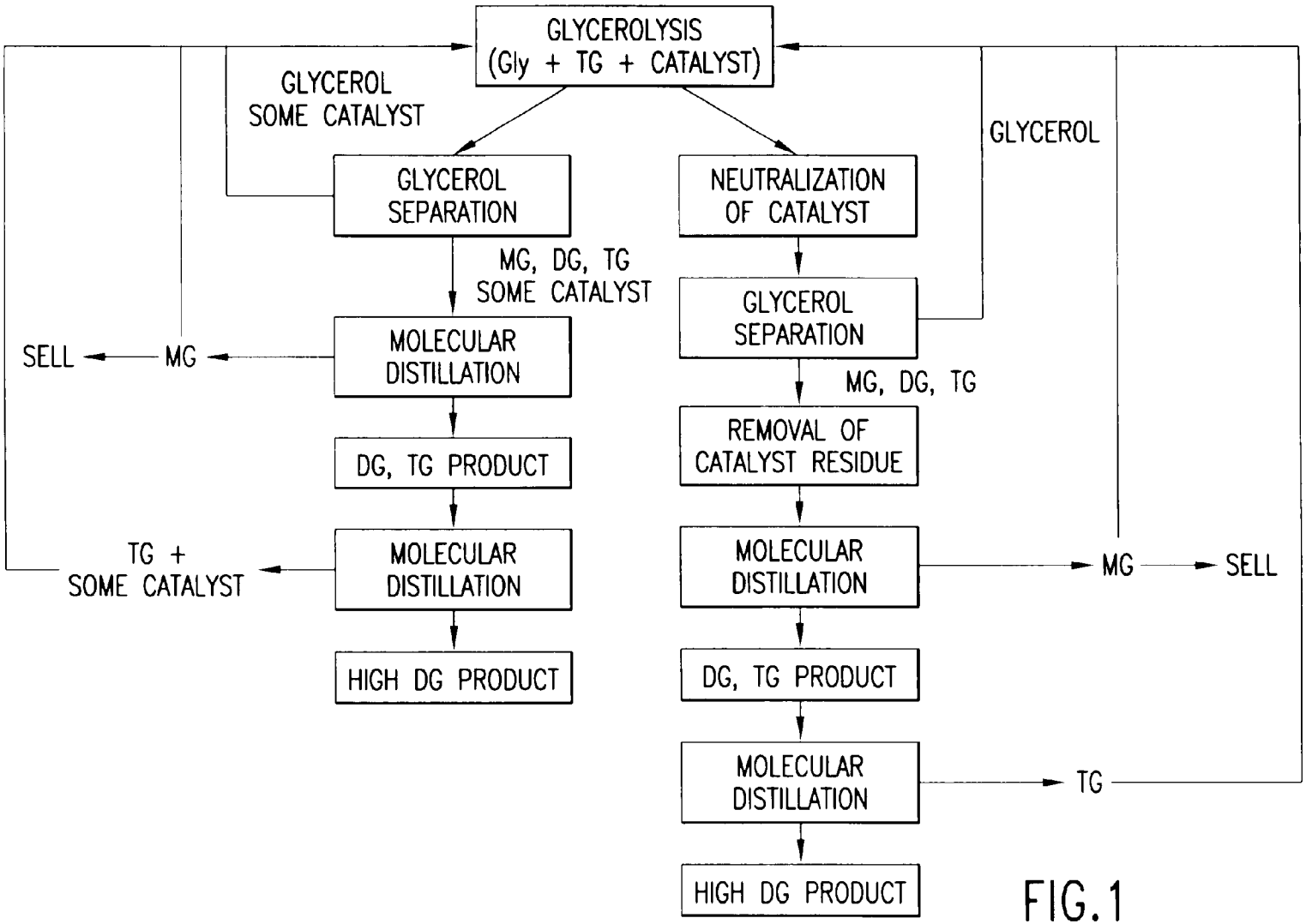
FIG. 1 diagrams two preferred embodiments of the method of the present invention.

The present invention provides a method of producing 1,3-diglyceride oils, the method comprising mixing triglyceride containing oil with glycerol and a catalyst comprising an alkali metal salt or alkali earth metal salt of a monocarboxylic acid or a di-carboxylic acid, or a mixture thereof, to achieve glycerolysis, wherein 1,3-diglyceride oil is produced.

In the present invention, glycerolysis of triglycerides to produce the edible DG oil is performed in a way to ensure minimal discoloration, to minimize the amount of catalyst, and to maximize the yield of diglycerides. Various triglyceride containing oils can be used in the method of the present invention. In a preferred embodiment, the triglyceride containing oil is selected from a group consisting of soybean oil, canola oil, corn oil, cottonseed oil, sunflower oil, butter fat, cocoa butter, illipe fat, milk fat, shea fat, borneo tallow, lard, lanolin, beef tallow, mutton tallow, animal fats, coconut oil, hazlenut oil, linseed oil, olive oil, palm oil, palm kernel oil, palm stearin, palm olein, palm kernel olein, palm kernel stearin, peanut oil, rapeseed oil, rice bran oil, safflower oil, vegetable oils, marine oils, menhaden oil, cod-liver oil, sardine oil, herring oil, orange roughy oil, partial or fully hydrogenated or fractionated oil, and a blend of one or more thereof.

The resulting product of glycerolysis is a mixture of partial glycerides, residual triglycerides and glycerol. The 1,3-diglyceride oil produced from the glycerolysis reaction can be further isolated. In a preferred embodiment, this reaction product is neutralized and stripped of residual glycerol through a steam distillation step. It is then cleaned of residual catalyst, and is subjected to a molecular distillation step to separate monoglycerides from the DG oil (>80% DG, <15% TG, and <3% MG). In an alternative embodiment, the reaction product is not neutralized prior to stripping of glycerol and separation of residual MG. The MG fraction can be sold as distilled MG for emulsifiers. The MG and glycerol can also be recovered from the reaction product, either after neutralization or without previous neutralization, and recycled back to the glycerolysis reaction. The DG oil can be further winterized to make a product that satisfies cold storage requirements. The DG can also be subjected to an additional molecular distillation step for increased DG purity and lighter color. In this case, the residual TG fraction (containing active catalyst in the case of no catalyst neutralization or removal) could be recycled back to the glycerolysis reaction.

Color is an important property of the edible DG oil. From among the alkali metal salts or alkali earth metal salts of mono-carboxylic acid or a di-carboxylic acid catalysts that were tried in glycerolysis, it was determined that potassium acetate caused the least discoloration. It was also determined that the development of color during glycerolysis could be minimized further when the potassium acetate catalyst was used with inert atmosphere in the reactor, either under pressure or without pressure. The process of the invention reacts under inert atmosphere with a pressure of 0 to 500 psi. Subjecting the reactants in the reaction vessel to vacuum to remove air is also a means for conducting the reaction under inert atmosphere. Some examples of inert atmosphere gases are $CO_2$, $N_2$, Ar, Ne, He, and the like. Reaction time and temperature were also optimized for minimal development of discoloration. The reaction time may be anywhere from 10 minutes to 8 hours with 20 minutes to 4 hours being a more preferred range. Optimal temperatures will range from 170° C. to 280° C., more preferably from 190° C. to 240° C. Those of ordinary skill in the art will recognize the relationship between pressure, temperature and time, and, with the guidance provided by the present disclosure, will be able to optimize the process parameters for particular situations and variations of the invention without undue experimentation. Almost no discoloration was observed with optimized conditions, which for exemplifying purposes only are set forth in the examples that follow. Minimizing the development of color during glycerolysis eliminates the need for extensive clean-up steps.

The ratio of glycerol to TG oil and the conditions for glycerolysis were optimized to maximize the diglyceride content of the product. The ratio of glycerol to TG determines the equilibrium composition (MG, DG and TG) of the reaction mixtures. Molar ratios of glycerol to TG which can be utilized for the reaction can range from 0.2:1 to 19:1. More preferred molar ratios of glycerol to TG would range from 1:1 to 9:1. The most preferred molar ratio of glycerol to TG is 1.5:1 to 2.5:1. The optimal amount of catalyst necessary to complete the reaction was determined to fall within a range of 0.001% to 10% (weight of catalyst to weight of oil in the reaction), with a more preferred range being 0.01% to 1.0%. The catalyst contributes to the production of color during the reaction; therefore, having too little of the catalyst in the reaction increases the reaction time which results in a darker color. Having too much of the catalyst in the reaction makes the reaction more expensive. Because of these contradicting effects of the catalyst, it is important to find the precisely optimal level of the catalyst for the reaction. In a preferred embodiment, moisture is removed from the reactants, before adding the catalyst, for maximized reactivity of the catalyst. The drying can be achieved by various methods known in the area of the art, for example evaporation under vacuum, use of molecular sieve, use of chemical compounds that absorb moisture such as anhydrous magnesium sulfate. The use of molecular sieve or solid chemical compounds to absorb moisture requires subsequent removal of these agents through means such as filtration or centrifugation.

In one embodiment of the invention, the catalyst is not neutralized or removed after the reaction but is recycled with the TG fraction back to the glycerolysis reaction. However, residual catalyst can cause glyceride reversion during glycerol stripping or molecular distillation, resulting in a decrease in DG content and an increase in TG; therefore, in a preferred embodiment of the present invention, the residual catalyst is removed, and this can be done in various ways. For example, after the glycerolysis, residual potassium acetate was neutralized with phosphoric acid and the product was then filtered (or centrifuged) to separate the resulting salts. The residual salts can further be removed, if necessary, by treating the neutralized reaction product with silica hydrogel. Silica hydrogel treatment worked best when the neutralized reaction mixture was first stripped of glycerol by steam distillation as compared to when the glycerol was still in the reaction mixture.

The composition of the chemically prepared DG oil was very similar in composition to the oil prepared enzymatically according to the patents discussed above. The chemically prepared DG oil also had a satisfactory color as a salad oil without any bleaching treatments. Conventional bleaching processes, such as bleaching with clay or activated carbon, can bleach this DG oil made using the instant process further to make an even lighter product. Even though the DG oil that was prepared from canola oil did not pass the cold test, the oil can be used in many other applications where the cold test is not critical. However, DG oil product that passes the cold-test was prepared by fractionating canola DG oil, as described in Examples 18 and 19.

EXAMPLES

The following examples are provided to further illustrate and describe the particular specific embodiments of the invention, and are in no way intended to limit the invention to the specific procedures, conditions or compositions described therein.

Prevention of Discoloration During Glycerolysis

As mentioned before, color is one of the important properties of many fat and oil products. Color of oils comes either from natural color pigments or from undesirable reaction products during processing. Generally, the undesirable color from processing is hard to remove by conventional process such as clay bleaching. Thus, preventing the development of color is the best and most economical way to manage the color of processed oil products. Catalysts and other reaction conditions affect the color of glycerolysis reaction mixtures greatly, and the following examples and the data in Table 1 show this effect. Automated Lovibond PFX990 (5.25" cell) was used to measure the redness and yellowness of the samples.

Example 1

Nusun oil (400 g) was placed in a 1-L round bottom flask and dried by heating the oil to 90° C. under vacuum for 30 minutes. Glycerol (80 g) and NaOH (1 g) were added with vigorous agitation to the dried oil. After a 3-hour reaction at 145° C., the reaction mixture was cooled before it was centrifuged to separate oil phase from residual glycerine for color measurement. The color of the oil phase was 12.5 Red and 70 Yellow. The original Nusun oil had color of 0. 8R and 4.1Y.

Example 2

The same procedure as in Example 1 was used, except the reaction time was 4 hours.

Example 3

The same procedure as in Example 1 was used, except the reaction time and temperature was 170° C. and 1 hour, respectively.

Example 4

Nusun oil (2500 g) was placed in a 5-L round bottom flask and dried by heating the oil to 90° C. under vacuum for 30 minutes. Glycerol (500 g) and potassium acetate (12.5 g) were added to the dried oil with vigorous agitation. The reaction was sparged with nitrogen gas. After 2.75 hour reaction at 200° C., the reaction mixture was cooled before it was centrifuged to separate oil phase for color measurement. The color was 1.6R and 8.4Y.

Example 5

Nusun oil (400 g) was placed in a 1-L round bottom flask and dried by heating the oil to 90° C. under vacuum for 30 minutes. Glycerol (80 g) and potassium acetate (2 g) were added to the dried oil with vigorous agitation. After 5-hour reaction at 200° C., the reaction mixture was cooled before it was centrifuged to separate oil phase for color measurement. The color was 2.6R and 23Y.

Example 6

The same procedure as in Example 5 was used, except the catalyst dosage was 0.25% on the weight of oil, the reaction temperature was 180° C. and reaction time was 6 hours. Under these conditions, the reaction was not completed, and color of the reaction mixture was not measured.

Example 7

The same procedure as in Example 6 was used, except the reaction temperature was 200° C. and the reaction time was 4.5 hours. The color was 3.6R and 31 Y.

Example 8

The same procedure as in Example 6 was used, except the reaction temperature was 220° C. and time of reaction was 1 hour. The color was 1.5R and 5.6Y

Example 9

The same procedure as in Example 8 was used, except the reaction time was 1.5 hour and $CO_2$ was sparged into the reaction mixture. Carbon dioxide gas was sparged during the entire reaction. The color was 1.0R and 5.6Y.

Example 10

The same procedure as in Example 9 was used, except canola oil (2500 g) was used and the reaction time was 2 hour. The color was 0.6R and 4.3Y. The original canola oil had a color of 0.5R and 3.8Y.

Sodium hydroxide or sodium methoxide are the usual catalysts for glycerolysis in commercial practice. As shown in Table 1, the reaction mixture after glycerolysis darkened greatly when NaOH was used as the catalyst. Longer reaction time and high temperature worsen the discoloration of the reaction mixture. The discoloration in the glycerolysis reaction mixture of the present invention was greatly reduced by using potassium acetate as the catalyst. The reaction temperature and time affected the color and completeness of reaction with the catalyst. As shown in Examples 9 and 10, the discoloration was minimized by running the reaction with potassium acetate as the catalyst and sparing $CO_2$ gas during the reaction. Almost no discoloration was observed in the material produced in Example 10.

TABLE 1

Lovibond color of the reaction mixtures of glycerolysis prepared at various conditions

| Examples | Oil | Glycerol (%) | Catalyst Type | Catalyst Dosage (%) | Rxn. Temp. (C.) | Rxn. Time (hr) | Sparge gas | Color Red | Color Yellow |
|---|---|---|---|---|---|---|---|---|---|
| | Nunsun (No treatment) | | | | | | | 0.8 | 4.1 |
| Example 1 | Nunsun | 20 | NaOH | 0.25 | 145 | 3 | No | 12.5 | 70 |
| Example 2 | Nunsun | 20 | NaOH | 0.25 | 145 | 4 | No | 18 | 70 |
| Example 3 | Nunsun | 20 | NaOH | 0.25 | 170 | 1 | No | 15 | 70 |
| Example 4 | Nunsun | 20 | KAc | 0.5 | 200 | 2.75 | N2 | 1.6 | 8.4 |
| Example 5 | Nunsun | 20 | KAc | 0.5 | 200 | 5 | No | 2.6 | 23 |
| Example 6 | Nunsun | 20 | KAc | 0.25 | 180 | 6 | No | Incomplete rxn. | |
| Example 7 | Nunsun | 20 | KAc | 0.25 | 200 | 4.5 | No | 3.6 | 31 |
| Example 8 | Nunsun | 20 | KAc | 0.25 | 220 | 1 | No | 1.5 | 9.7 |
| Example 9 | Nunsun | 20 | KAc | 0.25 | 220 | 1.5 | $CO_2$ | 1.0 | 5.6 |
| | Canola (No treatment) | | | | | | | 0.5 | 3.8 |
| Example 10 | Canola | 20 | KAc | 0.25 | 220 | 2 | $CO_2$ | 0.6 | 4.3 |

Catalyst Removal

In the present invention, the use of catalyst is optimized to ensure reaction completeness. In a preferred embodiment, the optimal amount of catalyst is also minimized to make catalyst removal more economical. Insufficient removal of the catalyst residue can cause glyceride reversion during glycerol stripping or molecular distillation, causing a decrease in DG and increase of TG in the final product. Conventional ways of removing catalyst include, for example, neutralizing the catalyst with acids, such as phosphoric acid, then filtering the resulting salts. Water wash or adsorption with various adsorbents can also be performed to remove the catalysts. In the following examples, various approaches were tested using minimal amounts of catalyst, neutralizing with acids, filtering or centrifuging the neutralized catalyst salts, and treating with silica hydrogel, in case the product oil requires further removal of catalyst salts. Neutralization and filtration removed most of the catalyst. Adsorption with commercially available adsorbents was used to further clean the oil. However, the use of adsorbents is not necessarily required. Silica hydrogel (TriSyl® 600) is relatively cheap and known to adsorb polar compounds in oil.

The results in Example 11 and Table 2 show how the DG oil can undergo undesirable glyceride reversion when residual catalyst has not been removed from the oil. Catalysts could be removed by TriSyl® treatment even when the reaction mixture had some residual glycerol in it. However, TriSyl® worked much better when used in previously glycerol-stripped DG oil. As those of skill in art will recognize other adsorbents such as rice hull ash, alumina, diatornaceous earth, bleaching clay and the like could be used for the same purpose.

Example 11

Glycerolysis reaction mixture was prepared as in Example 4. The mixture was treated with 3% TriSyl® 600, then glycerol was stripped from the mixture. Molecular distillation at 200–210° C. and 0.001–0.010 millibars pressure followed. The composition of the sample changed during the molecular distillation step due to glyceride reversion. The glyceride compositions are shown in Table 2.

TABLE 2

Effect of residual catalyst on glyceride composition as described in Example 11

| | After Glycerolysis | After TrySyl ® trtmt | After Stripping | After Distillation |
|---|---|---|---|---|
| Potassium (ppm) | 1830 | 890 | 890 | 890 |
| Glycerol (%) | 6.9 | 3.4 | 0.2 | 0 |
| MG (%) | 44.6 | 42.8 | 38.8 | 1.8 |
| DG (%) | 40.7 | 46.7 | 54.2 | 27.6 |
| TG (%) | 7.7 | 7 | 6.8 | 67.9 |

Example 12

Glycerolysis reaction mixture was prepared as in Example 10. After the glycerolysis reaction the reaction mixture was cooled to 110° C., then phosphoric acid was added to neutralize the catalyst before settling the mixture and separating the upper oil layer. Glycerol stripping was done after that at 150° C. for 30 minutes under 0.5–3 torr vacuum. The dosage of TriSyl® was 1.2% for the subsequent silica hydrogel treatment. With the silica filtered out, the potassium content of the silica-treated oil was 15.5 ppm. The silica-treated oil was then molecular distilled at about 210° C. and 0.001 millibars pressure to yield DG oil (in the distillation residue). There was no significant change in the ratio of DG/TG during the distillation at this potassium level.

Example 13

Glycerolysis reaction mixture was prepared as in Example 7. The mixture was neutralized with phosphoric acid before settling and filtering the upper oil phase. Potassium content of the filtered material was 38.4 ppm.

Example 14

Glycerolysis reaction mixture was prepared as in Example 9. The mixture was neutralized with phosphoric acid before settling and filtering the upper oil phase. Phosphorus content of the filtered material was 54.2 ppm. After glycerol stripping and treatment with 1% TriSyl® 600, the phosphorus content was 4 ppm.

Preparation of Diglyceride Oil

Diglyceride oils were prepared as described in Example 12 and 15. The canola DG oils had similar glyceride compositions as the commercial diglyceride oil that was prepared enzymatically. The ratio of positional isomers of diglycerides, 1,3-DG to 1,2-DG ratio, was also similar. Red color of the oil from Example 12 ($CO_2$ sparge) was light even without any bleaching treatment.

Example 15

The glycerolysis reaction mixture was prepared from canola oil (2500 g) using 0.5% potassium acetate as the catalyst on the weight of oil without $CO_2$ sparging. After neutralization and glycerol stripping, the mixture was treated with 10% TriSyl® 600. The silica-treated product was then subjected to molecular-distillation. The diglyceride oil (DG/TG oil) was collected as the distillation residue. Without $CO_2$ sparge, the DG/TG ratio of this oil was similar in composition to the enzymatically-prepared oil, but the color was darker (4.1R and 39Y) than in Example 12 (1.6R).

Bleaching of the Diglyceride Oil

The prepared diglyceride oil (the distillation residue from molecular distillation step) had a satisfactory color for a salad oil without any bleaching treatment. However, the oil could be further bleached by conventional bleaching process with bleaching clay, activated carbon and the like, Examples 16 and 17 show the bleaching effect.

Example 16

Canola diglyceride oil of Example 12 (300 g) was heated to 70° C. before adding 6 g of bleaching clay (SF105, Englehard) with vigorous agitation. After 2 minutes mixing at 70° C., the oil/clay slurry was heated to 100° C. and bleached for 20 minutes under 4–8 torr vacuum. Clay was filtered through a Whatman #40 filter paper under pressure. The clay bleached oil had a color of 1.4R Example 17

Canola diglyceride oil of Example 12 was bleached as described in Example 16, except 6 g bleaching clay and 3 g activated carbon was used. The bleached oil color was 1.1R.

Winterization of the Diglyceride Oil

The canola diglyceride oil could be further winterized as described in Examples 18 and 19 to make a product that would satisfy the cold storage test.

Example 18

Canola diglyceride oil of Example 12 was mixed with either hexane or acetone (30% v/v oil). Both solutions were winterized in a refrigerated bath at −15° C. overnight before filtration through Whatman #40 filter papers. Both liquid fractions, after solvent evaporation, passed the cold test.

Example 19

The same procedure as in Example 18 was used, except the fractionation temperature was −20° C. Again, both of the liquid fractions passed the cold test.

Having now fully described the present invention, it will be understood by those of ordinary skill in the art that this invention can be performed within a wide and equivalent range of conditions, formulations, and parameters without effecting the scope of the invention or any specific embodiments thereof. All patents, present application and publications cited herein are fully incorporated by reference herein in their entirety.

What is claimed is:

1. A method for producing 1,3-diglyceride oils, the method comprising mixing triglyceride containing oil with glycerol and a catalyst comprising an alkali metal salt or alkali earth metal salt of a mono-carboxylic acid or a di-carboxylic acid, or a mixture thereof, to achieve glycerolysis, wherein 1,3-diglyceride oil is produced.

2. The method of claim 1 wherein moisture is removed from said triglyceride containing oil and said glycerol prior to adding said catalyst.

3. The method of claim 2 wherein moisture is removed by use of vacuum, molecular sieve, or chemical compounds.

4. The method of claim 1 wherein the triglyceride containing oil is selected from a group consisting of soybean oil, canola oil, corn oil, cottonseed oil, sunflower oil, butter fat, cocoa butter, illipe fat, milk fat, shea fat, borneo tallow, lard, lanolin, beef tallow, mutton tallow, animal fats, coconut oil, hazlenut oil, linseed oil, olive oil, palm oil, palm kernel oil, palm stearin, palm olein, palm kernel olein, palm kernel stearin, peanut oil, rapeseed oil, rice bran oil, safflower oil, vegetable oils, marine oils, menhaden oil, cod-liver oil, sardine oil, herring oil, orange roughy oil, partial or fully hydrogenated or fractionated oil, and a blend of one or more thereof.

5. The method of claim 1 wherein the molar ratio of glycerol to triglycerides is 0.2:1 to 19:1.

6. The method of claim 1 wherein the molar ratio of glycerol to triglycerides is 1:1 to 9:1.

7. The method of claim 1 wherein the molar ratio of glycerol to triglycerides is 1.5:1 to 2.5:1.

8. The method of claim 1 wherein said catalyst is selected from a group consisting of a lithium, sodium, potassium, calcium, magnesium, or barium salt of a mono-carboxylic acid or a di-carboxylic acid or a mixture thereof.

9. The method of claim 8 wherein said catalyst is potassium acetate.

10. The method of claim 1 wherein said catalyst is present in concentrations in a range of 0.001% to 10% based on the weight of the oil in the mixture.

11. The method of claim 1 wherein said catalyst is present in concentrations in a range of 0.01% to 1.0% based on the weight of the oil in the mixture.

12. The method of claim 1 wherein said 1,3-diglyceride oil produced from said mixing has substantially no discoloration.

13. The method of claim 1 wherein said mixing is at a temperature between 170° C. to 280° C.

14. The method of claim 1 wherein said mixing is at a temperature between 190° C. to 240° C.

15. The method of claim 1 wherein said mixing step has a reaction time from 10 minutes to 8 hours.

16. The method of claim 1 wherein said mixing step has a reaction time from 20 minutes to 4 hours.

17. The method of claim 1 wherein said mixing is at a pressure between 0 to 500 psi.

18. The method of claim 17 further comprising sparging of inert gas into the mixture at said mixing step.

19. The method of claim 18 wherein said inert gas is selected from a group consisting of $CO_2$, $N_2$, Ar, Ne, and He.

20. The method of claim 1 wherein said mixing is under vacuum.

21. The method of claim 1 further comprising separating residual glycerol and monoglycerides from the 1,3-diglyceride oil produced.

22. The method of claim 21 wherein said separating of said residual glycerol and monoglycerides is by steam distillation and/or molecular distillation.

23. The method of claim 21 further comprising recycling said residual glycerol and monoglycerides back to the mixing step.

24. The method of claim 21 further comprising separating residual triglycerides from the 1,3-diglyceride oil produced.

25. The method of claim 24 wherein said separating of said residual triglycerides is by molecular distillation.

26. The method of claim 24 further comprising recycling said residual triglycerides back to the mixing step.

27. The method of claim 1 further comprising inactivating the catalyst.

28. The method of claim 27 wherein said inactivating of the catalyst is by neutralization with acids.

29. The method of claim 28 wherein said acid is phosphoric acid.

30. The method of claim 27 further comprising removing catalyst residue.

31. The method of claim 30 wherein said removing of catalyst residue is by filtration and/or centrifugation.

32. The method of claim 31 further comprising adsorbing said catalyst residue with an adsorbent.

33. The method of claim 32 wherein said adsorbent is silica hydrogel.

34. The method of claim 27 further comprising separating residual glycerol and monoglycerides from the 1,3-diglyceride oil produced.

35. The method of claim 34 wherein said separating of said residual glycerol and monoglycerides is by steam distillation and/or molecular distillation.

36. The method of claim 34 further comprising recycling said residual glycerol and monoglycerides back to the mixing step.

37. The method of claim 34 further comprising separating residual triglycerides from the 1,3-diglyceride oil produced.

38. The method of claim 37 wherein said separating of said residual triglycerides is by molecular distillation.

39. The method of claim 37 further comprising recycling said residual triglycerides back to the mixing step.

40. The method of claim 1 further comprising:

(a) inactivating the catalyst;

(b) separating residual glycerol and removing catalyst residue from the 1,3-diglyceride oil produced; and (c) separating monoglycerides from the 1,3-diglyceride oil produced.

41. The method of claim 40 further comprising recycling said residual glycerol and monoglycerides back to the mixing step.

42. The method of claim 40 further comprising separating residual triglycerides from the 1,3-diglyceride oil produced.

43. The method of claim 42 further comprising recycling said residual triglycerides back to the mixing step.

44. The method of claim 1 wherein the 1,3-diglyceride oil produced is further winterized.

* * * * *

US007081542C1

(12) INTER PARTES REEXAMINATION CERTIFICATE (0022nd)

United States Patent

Jacobs et al.

(10) Number: US 7,081,542 C1

(45) Certificate Issued: May 13, 2008

(54) CHEMICAL PROCESS FOR THE PRODUCTION OF 1,3-DIGLYCERIDE OILS

(75) Inventors: Lewis Jacobs, Decatur, IL (US); Immok Lee, Decatur, IL (US); George Poppe, Forsyth, IL (US)

(73) Assignee: Archer-Daniels-Midland Company, Decatur, IL (US)

Reexamination Request:
No. 95/000,213, Jan. 9, 2007

Reexamination Certificate for:

| | |
|---|---|
| Patent No.: | **7,081,542** |
| Issued: | **Jul. 25, 2006** |
| Appl. No.: | **10/263,331** |
| Filed: | **Oct. 3, 2002** |

Related U.S. Application Data

(60) Provisional application No. 60/327,762, filed on Oct. 3, 2001.

(51) Int. Cl.
*C11C 1/00* (2006.01)

(52) U.S. Cl. ..... 554/169

(58) Field of Classification Search ..... None
See application file for complete search history.

(56) References Cited

U.S. PATENT DOCUMENTS

| | | | |
|---|---|---|---|
| 2,634,234 | A | 4/1953 | Kuhrt et al. |
| 2,634,278 | A | 4/1953 | Kuhrt et al. |
| 2,634,279 | A | 4/1953 | Kuhrt et al. |
| 2,714,113 | A | 7/1955 | Kuhrt et al. |
| 3,637,773 | A | 1/1972 | Gibson et al. |
| 4,018,806 | A | 4/1977 | Wyness et al. |
| 4,263,216 | A | 4/1981 | Volpenhein |

FOREIGN PATENT DOCUMENTS

| | | |
|---|---|---|
| GB | 617708 | 2/1949 |

OTHER PUBLICATIONS

A. Tuncer Erciyes and Halidun Civelekoglu, On The Molecular Distillation Of Some Triglyceride Oils Of Turkish Origin, Chimica Acta Turcica 11 (1983) p. 191–199.

R.O. Feuge and A.E. Bailey, Modification Of Vegetable Oils VI. The Practical Preparation Of Mono– and Diglycerides, Oil & Soap, (1946) p. 259–264.

Norman O.V. Sonntag, Glycerolysis Of Fats And Methyl Esters—Status, Review and Critique, JAOCS (1982) vol. 59, No. 10, p. 795A–802A.

Hilditch and Williams, Chapter X: Synthetic Glycerides: Naturally Occurring Fatty Alcohols: Acyl Ethers Of Glycerol, The Chemical Constitution Of Natural Fats, (Chapman & Hall, London) (1964) p. 658–675.

A. Crossley, et al., Acyl Migration In Diglycerides, J. Chem. Soc. (1959) p. 760–764.

Dharma R. Kodali, et al., Acyl Migration In 1,2–dipalmitoyl–sn–glycerol, Chemistry and Physics Of Lipids (1990) vol. 52, p. 163–170.

*Primary Examiner*—Dwayne C. Jones

(57) ABSTRACT

A method for producing 1,3-diglyceride oils from triglyceride containing oils is disclosed. The method uses alkali metal salts or alkali earth metal salts of mono-carboxylic or di-carboxylic acids to drive glycerolysis under conditions such that commercial, food-quality 1,3-diglyceride oils are produced.

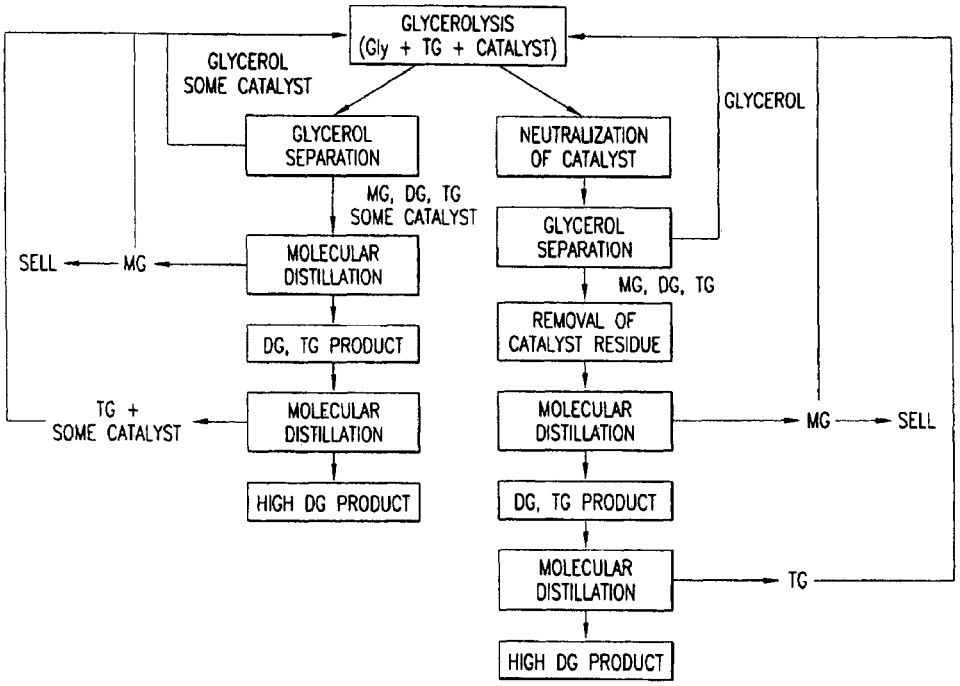

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1–40 are cancelled.

Claims 41–44 were not reexamined.

* * * * *